United States Patent [19]

Young

[11] Patent Number: 4,966,260

[45] **Date of Patent: * Oct. 30, 1990**

[54] TRAVEL BAG WITH MULTIPLE COMPARTMENTS

[75] Inventor: Raymond W. Young, West Bend, Wis.

[73] Assignee: Amity Leather Products Co., West Bend, Wis.

[ * ] Notice: The portion of the term of this patent subsequent to Apr. 18, 2006 has been disclaimed.

[21] Appl. No.: 324,296

[22] Filed: Mar. 15, 1989

Related U.S. Application Data

[63] Continuation of Ser. No. 60,723, Jun. 10, 1987, Pat. No. 4,821,853.

[51] Int. Cl.[5] ..... A45C 3/00; A45C 13/10; A45C 13/36

[52] U.S. Cl. ..... 190/111; 190/126; 190/903; 150/117; 150/128; 206/37; 206/235; 383/40; 383/97; 383/107

[58] Field of Search ..... 190/102, 108, 109, 111, 190/903, 126; 383/7, 22, 38–40, 97, 107; 150/154, 128, 112, 117, 111; 132/286, 312, 314, 315; 206/287.1, 37, 235; 224/30 A, 42.11, 905, 32 A; D3/37, 48, 71, 77

[56] References Cited

U.S. PATENT DOCUMENTS

| | | | |
|---|---|---|---|
| D. 101,439 | 10/1936 | Doppelt | D9/39 |
| D. 237,752 | 11/1975 | Bauer | D3/71 |
| D. 268,305 | 3/1983 | Stark | D3/77 X |
| D. 280,864 | 10/1985 | Allen | D3/39 |
| D. 291,150 | 8/1987 | Beran | D3/48 |
| 2,270,049 | 1/1942 | Greenstein | 383/40 X |
| 2,333,643 | 11/1943 | Donnellan | 323/38 X |
| 2,496,128 | 1/1950 | Lifton | 206/287.1 |
| 2,574,786 | 11/1951 | Hiatt | 383/38 |
| 2,620,005 | 12/1952 | Hall | 150/112 X |
| 3,061,057 | 10/1962 | Miller | 190/111 X |
| 3,115,959 | 12/1963 | Jaffe | 206/287.1 |
| 3,121,452 | 2/1964 | Hyman | 150/128 X |
| 3,221,959 | 12/1965 | Southwick | 383/40 X |
| 3,403,716 | 10/1968 | Siris | 383/38 X |
| 3,786,972 | 1/1974 | Alley | 224/32 A X |
| 3,831,651 | 8/1974 | Leahy | 150/111 X |
| 3,937,374 | 2/1976 | Hine, Jr. | 224/32 A |
| 3,955,727 | 5/1976 | Montgomery | 224/32 A X |
| 3,989,174 | 11/1976 | Norinsky | 224/32 A X |
| 4,081,061 | 3/1978 | Tucker | 190/108 |
| 4,258,869 | 3/1981 | Hilgendorff | 224/32 A |
| 4,301,849 | 11/1981 | Litwack et al. | 190/903 X |
| 4,442,960 | 4/1984 | Vetter | 224/32 A |
| 4,580,706 | 4/1986 | Jackson et al. | 224/32 A |
| 4,598,803 | 7/1986 | Ghiassi | 206/227.1 X |
| 4,629,040 | 12/1986 | Jones | 224/32 A X |
| 4,693,368 | 9/1987 | King et al. | 206/287.1 |

FOREIGN PATENT DOCUMENTS

| | | | |
|---|---|---|---|
| 231632 | 7/1944 | Switzerland | 224/32 A |
| 838553 | 6/1960 | United Kingdom | 190/111 |

*Primary Examiner*—Sue A. Weaver
*Attorney, Agent, or Firm*—Fitch, Even, Tabin & Flannery

[57] ABSTRACT

A travel bag has a plurality of internal compartments and can be reformed to provide different configurations for those compartments. In one configuration, four compartments are arranged side-by-side, with the pairs of compartments being mirror images of one another. The inner compartments enclose cavities which are pointed at their upper and bottom ends, while the outer compartments are expanded to have a rectangular cross-sectional configuration. Dart-like seams formed at corners of the outer expanded compartments maintain the rectangular cross-sectional configuration. The opposing compartment pairs are joined together by upper and lower wall portions forming a hinged connection therebetween. A first sliding fastener provides access to both inner compartments, while second and third sliding fasteners provide access to respective outer compartments. The three sliding fasteners are arranged parallel to each other so as to be upwardly facing.

10 Claims, 4 Drawing Sheets

TRAVEL BAG WITH MULTIPLE COMPARTMENTS

This is a continuation of application Ser. No. 07/060,723, filed June 10, 1987, U.S. Pat. No. 4,821,853.

BACKGROUND OF THE INVENTION

1. Field of the Invention

The present invention pertains to flexible bags of the soft luggage type and in particular to travel kits having multiple compartments for containing toiletry items.

2. Brief Description of the Prior Art

Over the years, travel kits and the like bags for carrying toiletry items have proven to be popular. In general, it is desirable to provide a travel kit with an arrangement which allows easy access to the interior of the bag for ready insertion and extraction of various toiletry and other items. Several arrangements have been proposed for providing entry into the interior of a travel bag or the like article.

For example, U.S. Design Pat. No. 101,439 discloses an elongated, generally rectangular travel bag for toilet articles, having a single zipper extending the length of its top wall. A considerable amount of unfolding and reforming of the bag is required, once the zipper is opened. When made of a fairly rigid material such as leather, it is sometimes quite difficult to reform the upper portion of the bag so as to align the zipper tracks of the top wall portions, to allow advancement of a slide fastener therealong to close the travel bag.

Rather than collect all the various items one might carry in a single compartment, it is generally desirable to arrange different items in different compartments, each separated from the other by barriers that prevent intermixing of the contents. It is further desirable to provide separate access to the various compartments, provided the bag arrangement is not complicated or otherwise confusing to a user who, perhaps, uses the bag only infrequently.

Further, it is generally desirable to provide a bag, especially a bag having a variety of different access points, with an ability to be reassembled into a variety of different configurations, placing the different access points in positions of prominence.

Usually, bags of this type are intended to be placed on flat, horizontal surfaces when used, to provide stability as the articles are inserted in or withdrawn therefrom. However, a user, such as a traveler accessing toiletry articles from a bag, often finds that a convenient resting place for the bag is not available. It is therefore desirable to provide a bag with alternate support while accessing the contents therewithin, and while storing the bag when not in use.

Various arrangements have been provided for imparting different configurations to a bag. For example, U.S. Pat. No. 4,301,849 discloses a multi-compartment bag which is reversible. That is, the bag can be turned inside-out to displace a different color fabric on its outside surface. The bag has multiple compartments arranged side-by-side. Two inner compartments have expanded bottoms, being generally triangular in cross-section. If provided, outer compartments have cavities which are wedge-shaped or sharply pointed in cross-section, at their top and bottom ends. The bag has two sets of strap-like handles, one set exposed and ready for use, the other set disposed within the compartments, ready for use should the bag be turned inside-out. Access to the bag's interior is gained by placing the bag on a flat horizontal surface in a customary manner while a series of zippers is manipulated to allow insertion or extraction of the bag contents. Two expanded compartments are releasably connected with snap fasteners at their bottom portions, the expanded bottom of the inner compartments being formed by a separate horizontal wall providing an enlarged bottom support surface for the bag. The bag further includes upwardly-extending strap-like handles at its upper end, with which the bag may be carried from place to place. When provided, the outer compartments are formed by sewing planar fabric walls onto opposing planar fabric walls of the inner compartments. Hence, the cavities formed by the outer compartments are restricted in size, having cross-sections which are sharply pointed at their top and bottom portions. Access to the outer compartments is provided by zippers on the outer sides of those compartments.

SUMMARY OF THE INVENTION

It is therefore an object of the present invention to provide a travel kit bag for toiletries and the like articles.

Yet another object of the present invention is to provide a travel kit bag having a plurality of compartments with multiple points of access among the compartments.

Yet another object of the present invention is to provide a travel kit bag which is easily and conveniently reformed into different configurations. A more particular aspect of the present invention is to provide a travel kit bag which is self-supporting when placed on a horizontal surface, and which can be configured for hanging support.

These and other objects of the present invention, which will become apparent from studying the accompanying drawings and description, are provided in a travel bag having a plurality of walls joined together so as to form two side-by-side pairs of compartments which are also arranged side-by-side. The inner, opposing compartments of each pair are joined together at their upper ends by upper and lower generally opposing wall portions. The upper wall portion has slide fastener means for forming an openable entrance to both of the inner compartments, and the lower wall has a surface for hangingly supporting two pairs of compartments. The remaining, outer compartments each have generally opposing inner and outer walls spaced from each other at their top and bottom ends, each carrying a respective slide fastener at their top end for forming an openable entrance into the outer compartments.

BRIEF DESCRIPTION OF THE DRAWINGS

In the drawings, wherein like elements are referenced alike.

DETAILED DESCRIPTION OF THE PREFERRED EMBODIMENT

Figure 1:
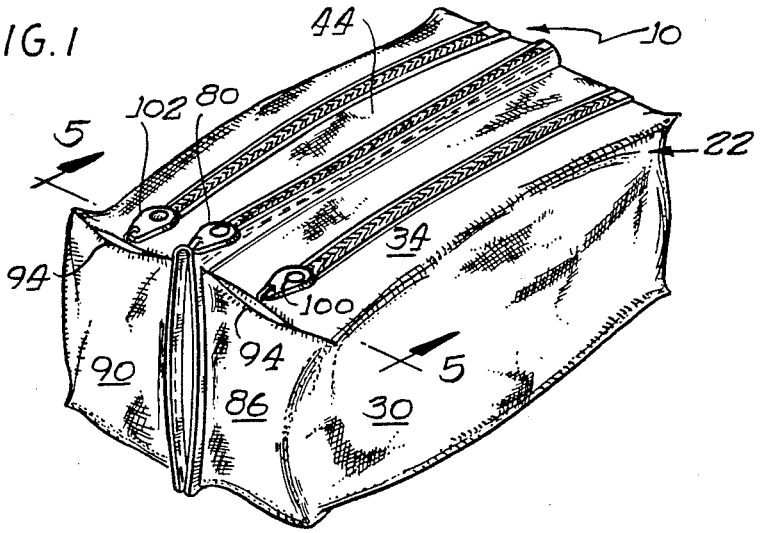
FIG. 1 is a perspective view of a travel bag constructed according to the principles of the present invention.

Referring now to the drawings, a travel kit bag constructed according to the principles of the present invention is illustrated generally at 10. In the preferred embodiment, the bag 10 is made from wall sections of flexible material such as a nylon fabric or the like. However, as will be appreciated, the travel bag can be formed from a variety of materials, including materials which are relatively inflexible compared to soft luggage. For example, bag 10 can be made from a relatively thick leather stock.

Figure 4:
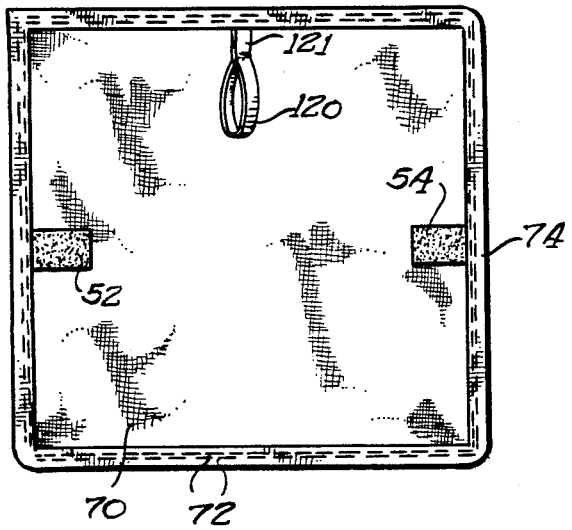
FIG. 4 is a bottom plan view of the travel bag of FIG. 2.
Figure 5:
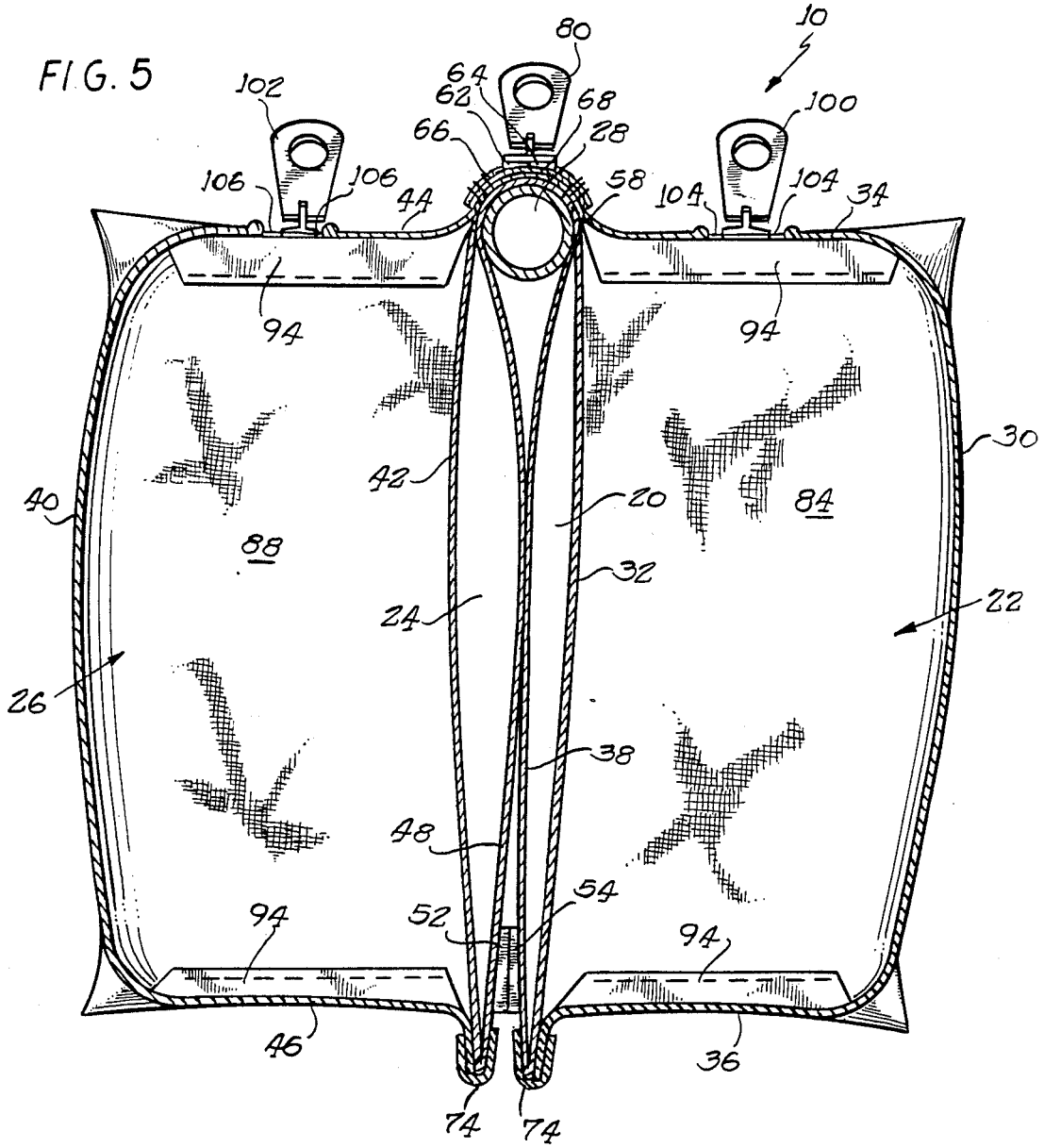
FIG. 5 is a side elevational view taken in cross-section along the line 5—5 of FIG. 1.

Generally, bag 10 is constructed to provide two principal configurations, a closed or saddlebag-like configuration (see FIGS. 1 and 5) and an open or low profile configuration (see FIGS. 2–4 and 6). When in its closed configuration, bag 10 has a plurality of compartments, each arranged side-by-side. As can best be seen in the cross-sectional view of FIG. 5, four compartments are provided, each generally coextensive in height. As illustrated, the preferred embodiment of bag 10 is symmetric about the vertical center line with pairs of compartments arranged on either side of the center line, the pairs being mirror images of each other. With reference to FIG. 5, the right-hand pair of compartments includes an inner compartment 20 and an outer expanded compartment 22. The left-hand pair of compartments has a similar arrangement of an inner compartment 24 and an outer expanded compartment 26. According to one aspect of the present invention, the outer compartments 22, 26 are generally parallelepiped or more particularly, rectangular in cross-section, whereas the inner pockets 22, 24 define cavities whose cross-sections have sharply pointed ends at their top and bottom portions. As illustrated in FIGS. 1 and 5, the travel bag 10 is arranged in its folded configuration, with FIG. 1 showing the travel bag resting on a horizontal support surface, and FIG. 5 showing the travel bag hanging from a bar 28, such as a towel bar or the like.

Turning now to a more detailed description of bag 10, outer expanded compartment 22 includes an outer sidewall and opposed inner wall 32, joined between top and bottom walls 34, 36, respectively. The inner compartment 20 is formed between an outer wall, preferably the wall 32, and an inner wall 38. Thus, wall 32 is a common wall separating inner and outer compartments 20, 22. The left-hand pair of compartments 24, 26 is a mirror image of those compartments described above, and accordingly has a similar construction. Outer compartment 26 has an outer wall 40, an opposed inner wall 42, and top and bottom walls 44, 46, respectively. Wall 42 provides a common barrier between inner and outer compartments 24, 26. Inner compartment 24 is formed between wall 42 and an inner wall 48. As will be seen herein, the pair of compartments 20, 22 forms a unitary construction, as does the other pair of compartments 24, 26. The pairs of compartments 20, 22 and 24, 26 are releasably joined together at their bottom ends by releasable fasteners 52, 54 which preferably comprise hook-and-loop fastener material, but may also comprise snap fasteners, flexible magnetic members, or the like.

In the folded configuration of FIGS. 1 and 5, the upper ends of the compartment pairs 20, 22 and 24, 26 are joined together through two wall portions, the first, lower wall portion 58, is formed at the joinder of inner walls 38, 48 and, when the bag receives hanging support, engages a support such as the bar 28 shown in FIG. 5. The upper wall portion which generally overlies bar 28, is formed by the opposing edges of the top walls 34, 44 and includes a slide fastener 80 which provides access to both inner compartments 20, 24. The tracks for slide fastener 80 are attached directly to the walls of the bag. For example, the left-hand fastener track 62 is attached to the inner edge of wall 44, where wall 44 is joined to wall 42 while the other track 64 is attached to the inner end of wall 34, where that wall is joined to wall 32. The illustrated bag 10 preferably includes ribbing or welting 66, 68 overlying the sewn seam where the tracks are fastened to their respective wall ends, to provide an attractive, aesthetically pleasing appearance. As described above, bag 10 is preferably formed of a flexible material. Thus, when hung across a bar 28, the upper and lower wall portions 58, 60 are pressed into intimate engagement with one another by the weight of the compartment pairs, as well as the contents carried therein. Thus, the inner compartments 20, 24 are effectively sealed from each other by the intimate engagement of wall portions 58, 60.

If desired, the inner walls 38, 48 can be discontinuous, sewn or otherwise joined together at the lower wall portion 58. However, according to one aspect of the present invention, the inner walls 38, 48 as well as the lower wall portion 58 are preferably formed of a continuous integral panel or sheet of material, which, as most clearly shown in FIG. 4, is generally rectangular in configuration. The sheet of material is designated by the numeral 70 and is joined to the compartment walls by stitched seams 72, the appearance of which is enhanced by a welting or ribbing 74. When the releasable fasteners 52, 54 are separated, the compartment pairs may be swung away from each other, with a hinging movement about the lower wall portions 58, 60, to assume the position shown in FIGS. 2, 3, 4 and 6.

Figure 6:
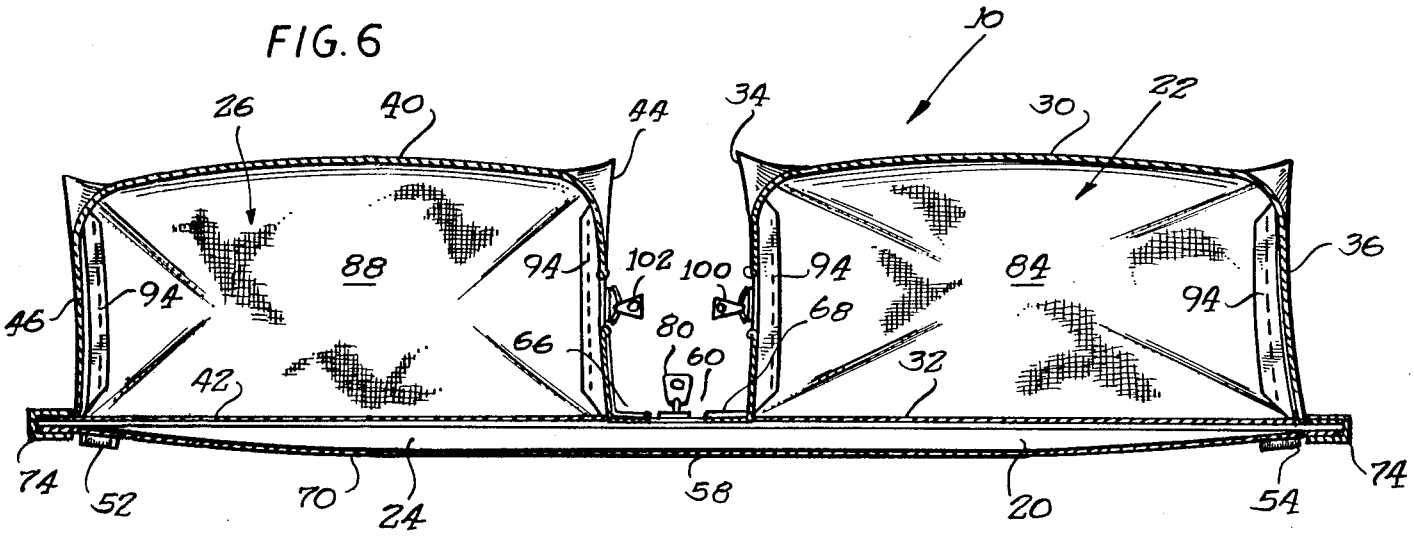
FIG. 6 is an elevational view in cross-section, taken along the line 6—6 of FIG. 2.

As shown most clearly in FIG. 6, when in the expanded or open configuration, inner compartments 20, 24 form a single continuous cavity, access to which is gained by advancing a slide fastener 80 along slide fastener tracks 62, 64, thereby providing a slit-like opening into the combined cavities 20, 24. As well as providing convenient storage for relatively large, flat items in the combined space of cavities 20, 24, the open configuration of the travel bag provides a convenient configuration for storage within a large bag, such as a suitcase. The expanded compartments 22, 26, if made of flexible material, are compressible, allowing bag 10 to assume a relatively flat sheet-like configuration. Further, even when filled with articles, the expanded compartments 22, 26 occupy a minimum volume when bag 10 is packed in a suitcase or the like. The combined space of cavities 20, 24 forms a unitary compartment generally coextensive with and underlying the outer compartments 22, 26. The unitary compartment is bounded on its lower side by sheet 70 which forms an outer, lower wall of bag 10. The central portion of sheet 70 forms the hinge-like bearing surface which hangingly supports bag 10 from rod 28, as illustrated in FIG. 5.

Referring now to FIGS. 2, 3 5 and 6, the expanded compartments 22, 26 form a three-dimensional enclosure having generally rectangular walls. In addition to the top, bottom, inner and outer walls described above, each of the expanded compartments 22, 26 have opposing end walls 84, 86 and 88, 90, respectively. To define the expanded nature of the generally rectangular compartments 22, 26, each compartment has four expansion means or dart-like seams 94 which generally extend away from the plane of material sheet 70 when the bag is in the opened configuration, and away from the portions 38, 48 of material sheet 70 when the bag is in its folded configuration. The seams 94 hold the inner and outer walls of each expanded compartment apart from each other. This feature can be seen in the cross-sectional view of FIG. 5 wherein, the generally horizontally-extending dart-like seams 94 hold the outer walls 30, 40 of expanded compartments 22, 26 apart from their corresponding inner walls 32, 42, thereby imparting a generally rectangular configuration to the end walls 84, 86 of compartment 22 and 88, 90 of compartment 26. As shown most clearly in FIGS. 2 and 6, this same expansion of compartments 22, 26 is maintained when the bag is in its open position, with the dart-like seams 94 being generally vertically oriented.

According to one aspect of the present invention, the relatively narrow, expanded compartments 20, 24 are located at the interior of travel bag 10 when the bag is arranged in its folded configuration. This allows the expanded compartments 22, 26 to assume outer positions of the bag 10, so as to provide a convenient saddle-bag type configuration when the compartment pairs are arranged to straddle a bar such as the towel bar 28. Referring especially to FIG. 5, according to other aspects of the present invention, when bag 10 is arranged in its saddle-bag-like configuration, three: slide fasteners 80, 100, 102 are conveniently located on horizontal surfaces allowing easy access to the compartment cavities within the bag 10. That is, slide fastener 80 can be advanced to open slit-like access to the interior of unexpanded compartments 20, 24, while the lower wall portion 58 maintains the structural integrity of bag 10, uniting the opposing compartment pairs. In addition to the slide fastener 80, slide fasteners 100, 102 ride on respective pairs of slide fastener tracks 104, 106, positioned on the top walls 34, 44 of respective outer compartments 22, 26. Slide fasteners 100, 102 provide access to the interior of the expanded compartments 22, 26. Thus, toiletry articles available in relatively bulky can and bottle containers are easily stored in the outer expanded compartments 22, 26, while other articles having a relatively thin cross-section can be stored in inner compartments 20, 24. In particular, the interior walls 32, 42 of expanded compartments 22, 26 are arranged directly below the supporting bar for the folding bag, while preserving the rectangular configuration of the outer compartments suspended in cantilever fashion from the upper and lower portions 58, 60. Thus, a uniformly wide path for relatively bulky articles stored within the expanded compartments facilitates easy insertion and extraction of articles within those compartments. Slide fasteners 80, 100, 102 preferably comprise nonmetallic zippers, but other arrangements are possible. For example, metallic zippers, interlocking plastic strips or other slide fastener arrangements may be used.

According to other aspects of the present invention, a travel bag of economical construction is provided with moisture barriers between its several compartments. Preferably, the various walls of the compartments described above are formed from the same lined material having a first surface of attractive appearance and design, and an opposed surface, providing a moisture-proof, moisture-resistant barrier. The moisture barriers between internal compartments are provided with a single layer of material, only one side of which has a moisture-proof, or moisture-resistant lining. As previously mentioned, the panel 70 shown in FIG. 4 is generally rectangular in configuration, and preferably is generally square. In one embodiment, the sides of panel 70 measure approximately 10½ inches by 11½ inches, so as to present the generally square appearance as shown at FIG. 4. When folded into the configuration shown in FIGS. 1 and 5, the internal walls 38, 48 comprise rectangles with sides having a length-to-height proportion of two-to-one which aids in stabilizing the travel bag when hung over a towel bar. To further aid in stability, the opposing inner walls 38, 48 are preferably attached together by releasable attachments 52, 54 (see FIGS. 5 and 6) to prevent a vertical shifting of one compartment pair on one side of the towel bar, relative to the other compartment pair.

Referring to the preferred construction of bag 10, the material of the outer compartments 22, 26 and the panel 70 is arranged so that the attractive, design surface is outwardly facing, with the moisture barrier inwardly facing, hidden from view. In the preferred construction of bag 10, each outer pocket 22, 26 is formed from an integral sheet of lined material. It will be appreciated by those skilled in the art that the outer compartments 22, 26 need not be formed with the dart-like seams 94 at the corners, but, as explained above, this construction is preferred since it lends an expansion means for separating the major walls of the outer compartments. The dart-like seams are visible in cross-sectional views FIGS. 5 and 6, with the lined material being visible in those Figures by virtue of the seam construction. Construction of bag 10 is completed with the intermediate walls 32, 42 which, with reference to FIG. 6, are arranged such that the finished or attractive design surfaces face into the interior of the outer compartments 22, 26. It has been found that a double wall construction in the interior of bag 10 is not necessary to provide the desired water-resistant features or the structural strength required when the bag is resting on a horizontal surface or hanging suspended from a bar-like member. As shown in FIG. 6, the planar-like wall 70 is arranged to oppose the medial walls 32, 42, having end seams joined by a simple stitching of the overlapped ends (see welting 74). This construction of the bag 10 results in an economical fabrication and an attractive appearance while providing the various functional aspects and features described above.

Figure 2:
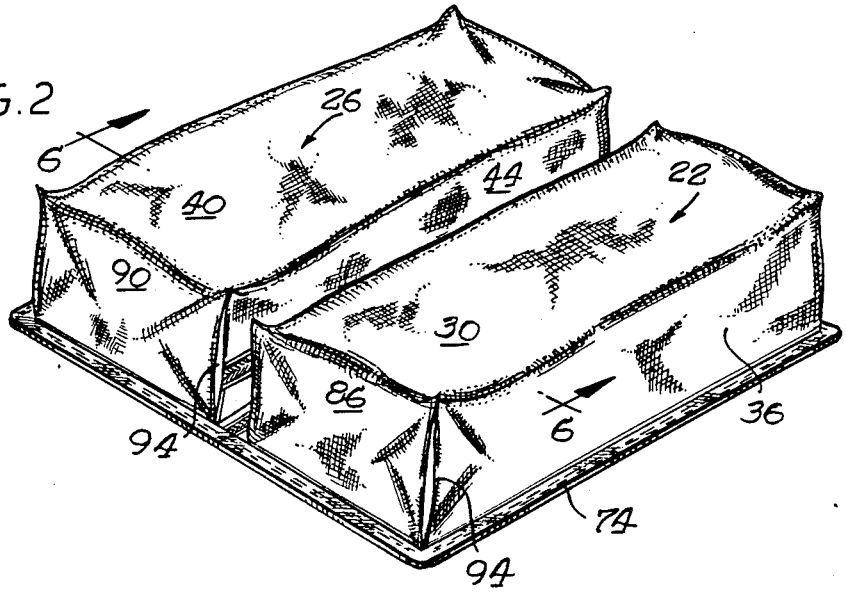
FIG. 2 is a perspective view of the travel bag of FIG. 1, the travel bag having been reconfigured into a second, opened position.
Figure 3:
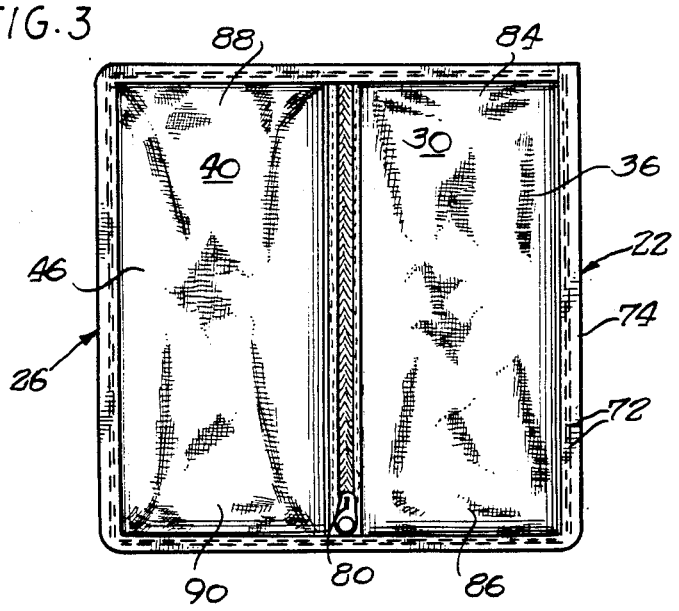
FIG. 3 is a top plan view of the travel bag of FIG. 2.

If desired, a loop-like strap 120 can be provided as shown in FIG. 4. One end 121 of the loop is secured to bag 10 by being placed under the welting 74 prior to the stitching 72 which joins the various walls panels described above. Strap 120 is positioned to oppose the slide fastener 80 of FIG. 2 when, as shown, the slide fastener is in its closed position. By being sewn under welting 74, the loop 120 is biased against the outer surface of panel 70 when not in use. If desired, bag 10 can be hung from strap 120, such that the end walls 86, 90 are upwardly facing, with the traveling fasteners 80, 100 and 102 located at the upper end of the bag when in a closed position. As can be seen in FIGS. 2 and 6, when the bag is in the opened position, and arranged to hang from strap 120, the three traveling fasteners are positioned close to the hanging support, their tracks being tensioned by the weight of the bag and the contents carried therein.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A travel kit comprising:

first and second generally parallelepiped compartments, each having an upper wall and a lower wall, inner and outer sidewalls, and a pair of end walls, the upper and lower walls having preselected widths, each of said first and second compartments comprising a single, integral member which makes up the outer sidewall, end walls, lower wall, and an outer portion of the upper wall of the respective compartment;

flexible connecting means joining said first and second compartments;

slide fastener closures extending along each upper wall, each of said slide fastener closures having a width substantially less than the width of said upper walls;

spacing means in each of said compartments for maintaining the generally parallelepiped configurations thereof, said spacing means extending between said side walls;

said first and second compartments being pivotable about said connecting means to a position in which said upper walls of said respective compartments and their associated slide fastener closures face each other, and the travel kit assumes a relatively low profile;

a looped strap disposed substantially centrally of one end of said connecting means for suspending said travel kit;

a third compartment defined by portions, respectively, of said first compartment, said second compartment, and said connecting means; and a third slide fastener closure providing controlled access to said third compartment, said third slide fastener closure extending along the length of said connecting means.

2. A travel kit in accordance with claim 1 wherein said third compartment includes an inner wall disposed opposite the inner sidewalls of the respective first and second compartments, said inner wall having complementary hook-and-loop fastener means disposed at opposite ends to enable the opposite ends of the inner wall to be attached to one another.

3. A travel kit for carrying toilet articles and the like, comprising:

first and second flexible elongated compartments, each said compartment being formed of one or more layers of a flexible material; and flexible connecting means extending between said compartments and generally parallel thereto, and pivotably connecting said flexible compartments to one another;

each said compartment having a zipper extending along its length to selectively provide access to its interior;

said travel kit being capable of assuming a first configuration in which said compartments are oriented side by side and said connecting means extends along adjacent upper edges of said compartments;

said travel kit also being capable of assuming a second configuration by pivoting each of said compartments away from the other about said connecting means through an angle of about 90°;

said travel kit having a relatively low profile in said second configuration and having horizontal dimensions of about 10½ in. by 11½ in.;

each of said first and second compartments comprising, with reference to said first configuration, an inner sidewall, an outer sidewall, a pair of end walls, a top wall, and a bottom wall, with a single, integral member making up the outer sidewall, the end walls, the bottom wall, and an outer portion of the top wall; and each of said first and second compartments further having a plurality of seams extending between said inner sidewall and said outer sidewall to define corners for said outer sidewall.

4. A travel kit in accordance with claim 3 wherein said travel kit further comprises a divided third compartment defined by portions, respectively, of said first compartment, said second compartment, and said connecting means, and a third zipper providing controlled access to said third compartment, said third zipper extending along the length of said connecting means.

5. A travel kit in accordance with claim 4 wherein said travel kit further includes a looped strap disposed substantially centrally of one end of said connecting means for suspending said travel kit.

6. A travel kit in accordance with claim 5 wherein said third compartment includes an inner wall disposed opposite the inner sidewalls of the respective first and second compartments, said inner wall having complementary hook-and-loop fastener means disposed at opposite ends to enable the opposite ends of the inner wall to be attached to one another.

7. A travel kit in accordance with claim 6 wherein each of said first and second compartments is generally parallelepiped.

8. A travel kit comprising:

first and second generally parallelepiped compartments, each having an upper wall and a lower wall, inner and outer sidewalls, and a pair of end walls, the upper and lower walls having preselected widths, each compartment having its lower wall and end walls joined to its inner wall, said walls defining for each compartment an interior separate from that of the other compartment, and each of said first and second compartments comprising a single, integral member which makes up the outer sidewall, end walls, lower wall, and an outer portion of the upper wall;

flexible connecting means joining said first and second compartments;

slide fastener closures extending along each upper wall, each slide fastener closure providing selective access to a respective one of said interiors of said compartments, each of said slide fastener closures having a width substantially less than the width of said upper walls;

spacing means in each of said compartments for maintaining the generally parallelepiped configurations thereof, said spacing means extending between said side walls;

said first and second compartments being pivotable about said connecting means between a first position in which the inner walls of said first and second compartments lie directly adjacent one another, and a second position in which said upper walls of said respective compartments and their associated slide fastener closures face each other, and the travel kit assumes a relatively low profile;

a third compartment defined by portions, respectively, of said first compartment, said second compartment, and said connecting means; and a third slide fastener closure providing controlled access to said third compartment, said third slide fastener closure extending along the length of said connecting means.

9. A travel kit in accordance with claim 8 further comprising a looped strap disposed substantially centrally of one end of said connecting means for suspending said travel kit.

10. A travel kit in accordance with claim 8 wherein said third compartment includes an inner wall disposed opposite the inner sidewalls of the respective first and second compartments, said inner wall having complementary hook-and-loop fastener means disposed at opposite ends to enable the opposite ends of the inner wall to be attached to one another.

* * * * *